US008033758B1

(12) United States Patent
Burkett

(10) Patent No.: US 8,033,758 B1
(45) Date of Patent: Oct. 11, 2011

(54) APPARATUS AND METHOD FOR MAKING A POLYMER SHEET PILING WALL

(76) Inventor: Darryl Scott Burkett, Fox River Grove, IL (US)

( * ) Notice: Subject to any disclaimer, the term of this patent is extended or adjusted under 35 U.S.C. 154(b) by 207 days.

(21) Appl. No.: 11/888,779

(22) Filed: Aug. 2, 2007

(51) Int. Cl.
*E02D 5/02* (2006.01)

(52) U.S. Cl. ..... 405/274; 405/276; 405/285

(58) Field of Classification Search ..... 405/262, 405/274, 275, 276, 284, 285, 286
See application file for complete search history.

(56) References Cited

U.S. PATENT DOCUMENTS

| | | | | |
|---|---|---|---|---|
| 4,674,921 | A * | 6/1987 | Berger | 405/262 |
| 4,917,543 | A * | 4/1990 | Cole et al. | 405/262 |
| 6,443,655 | B1 * | 9/2002 | Bennett | 405/114 |
| 2005/0163575 | A1 * | 7/2005 | Dagher et al. | 405/274 |

FOREIGN PATENT DOCUMENTS

| | | | |
|---|---|---|---|
| JP | 62055335 | A * | 3/1987 |
| JP | 06306866 | A * | 11/1994 |

* cited by examiner

*Primary Examiner* — David Bagnell
*Assistant Examiner* — Benjamin Fiorello
(74) *Attorney, Agent, or Firm* — Erickson Law Group, PC

(57) ABSTRACT

A sheet piling wall includes a plurality of polymer corrugated sheet piles, such as vinyl sheet piles, connected together to form an corrugated wall structure having a front surface and a back surface. A plurality of blocks are adhesively secured to the back surface of the wall structure. Each block includes a fastener that is fastened to a bracket that is welded to a support bar extending horizontally behind the back surface. The support bar can be anchored to solid ground by use of tie back rods and an earth anchorage system.

11 Claims, 5 Drawing Sheets

*FIG. 9*
PRIOR ART
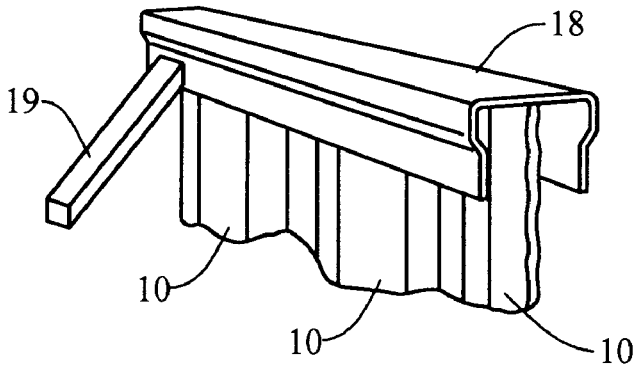
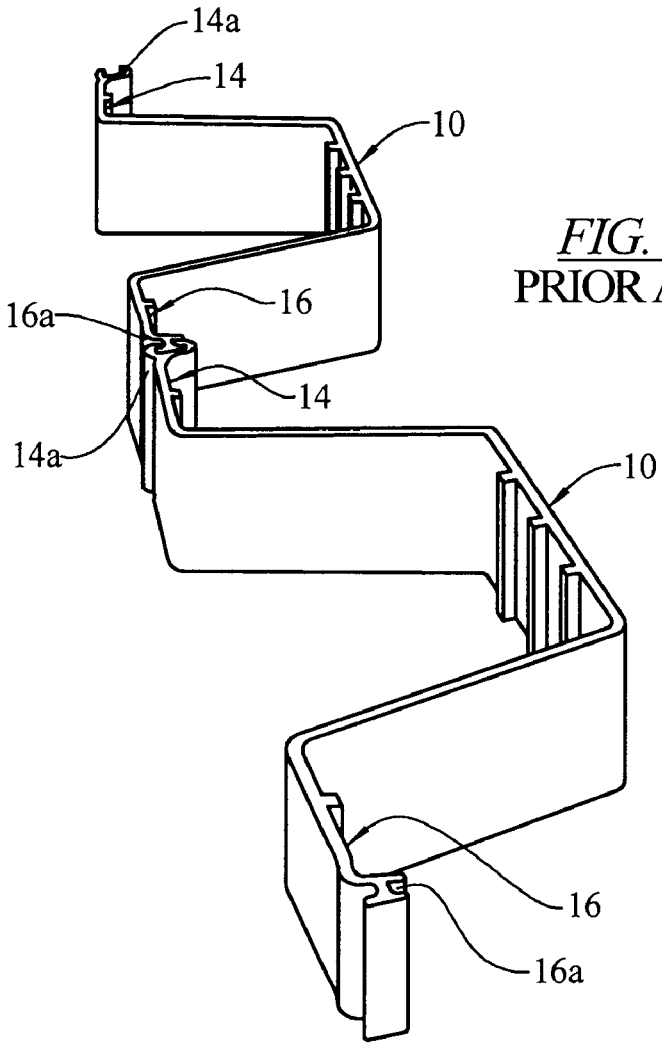
*FIG. 8*
PRIOR ART

APPARATUS AND METHOD FOR MAKING A POLYMER SHEET PILING WALL

TECHNICAL FIELD OF THE INVENTION

The present invention relates to sheet piling walls constructed by interlocked sheet piles.

BACKGROUND OF THE INVENTION

The properties of golf courses, commercial and industrial properties, and luxurious homes often contain a body of water such as a lake, pond, or stream. To protect the shoreline from erosion and to add to the aesthetic appeal of the property, a shoreline wall is sometimes used.

It is known to use sheet piles to construct these walls. It also known to anchor the sheet piling wall by welding a horizontal support bar to a back side of the wall, along the length of the wall, welding tie back rods to the support bar and extending the tie back rods in a direction away from the water to connect to an underground earth anchor.

U.S. Pat. Nos. 5,447,393 and 6,053,666 illustrate examples of steel sheet pile configurations. According to these patents the steel sheets interlock with one another and form an undulating or corrugated wall. Although steel sheet piling is an effective method to construct a shoreline wall, under some circumstances it can rust when exposed to water and become less than aesthetically attractive.

Colored vinyl sheet piling walls are known and are aesthetically attractive, but because the vinyl sheet piles cannot be welded on a back side, and it is sometimes undesirable to provide holes through the sheet piles for fasteners, a top cap is used.

FIGS. 8 and 9 illustrate prior art components used to construct a typical vinyl sheet piling wall. FIG. 8 illustrates two vinyl sheet piles 10 that each have a substantially U shape cross-section with extending side flange portions 14, 16. The flange portions 14, 16 include interlocking formations 14*a*, 16*a* along their length such that the piles 10, 10 can be driven side by side sequentially, and mutually interlock as each subsequent sheet pile is driven into the ground, forming a corrugated wall. As shown in FIG. 9, a top cap 18 is set on the sheet piles 10 and captures the top of the vinyl sheet piles 10. The top cap 18 is connected to tie back members 19 which are connected to earth anchorage to stabilize the sheet piling wall. The tie back members 19 are buried by backside fill. Top cap members 18 are typically provided in straight stock length. Any curvature of the wall must be accommodated by miter cutting sections of the top cap 18. Because of the need for the top cap, a vinyl wall is difficult to construct along a curved or irregular path.

The present inventor has recognized the need for a method of installing polymer or non-metallic sheet piles, such as vinyl sheet piles, that results in an attractive, stable wall.

The present inventor has recognized the need for an efficient method of installing a polymer sheet piling wall, such as a vinyl wall, along a curved path.

SUMMARY OF THE INVENTION

The present invention provides an improved method of installing a wall of polymer or plastic material, particularly vinyl material, for retaining earth or water. The method results in a wall that is efficiently and economically constructed and is usable for shoreline stabilization, dams, waterfalls, spillways, and revetments. The invention provides a wall that is attractive, long lasting, and will not rust. The wall can be installed using construction equipment such that the wall can be installed in hard-to-access areas such as lakes or ponds inside golf courses.

According to the preferred embodiment, the wall is composed of vinyl sheet piles.

The present invention provides a wall system that includes a wall structure formed by vertically arranged vinyl sheet piles, steel beams placed underground and set back from the wall structure that anchor the wall to earth, a horizontal steel support bar that reinforces the wall, a plurality of steel brackets, a plurality of blocks that are glued with a special adhesive to an back side of the wall structure, each of which is bolted to one of the steel brackets, the steel brackets being welded to the steel support bar, and a plurality of tie back rods that are welded to the steel bar and the steel beams.

In one version of the present invention, a plurality of tubular metal stakes are driven into the ground to layout the desired path of the wall. The steel support bar is then arranged horizontally following the layout of the stakes and welded to the stakes. Steel tie back rods are welded to the support bar and extended substantially horizontal away from the support bar to be connected to steel wide flange beams or I beams which have been driven into the earth vertically to function as earth anchors. Vinyl sheet piles are then driven one at a time, side-by-side in interlocking fashion to form a wall structure against the support bar. A plurality of vinyl blocks are provided. Each vinyl block includes a countersunk hole for receiving a carriage bolt. The countersunk hole provides a recess at a side nearest the vinyl sheet pile. The recess functions to receive the head end of the bolt, recessed below a back surface of the block. The threaded shank of the carriage bolt extends out of the block on a side of the block opposite the sheet pile. The vinyl blocks are spaced apart along a length of the wall structure and glued to a back side of the wall structure by a special adhesive at positions below the support bar. During the time it takes the special adhesive to set, two screws are used to secure each vinyl block to a vinyl sheet pile of the wall structure. The two screws do not penetrate entirely through the vinyl wall and function only to clamp the block to the vinyl sheet pile while the adhesive sets. Once the special adhesive sets, the vinyl block is permanently secured to the vinyl sheet pile.

The vinyl block is then bolted to the steel bracket by means of the carriage bolt. A nut is placed on the threaded shank after the threaded shank is passed through a hole through the steel bracket. The nut is tightened against the bracket which fastens the bracket tightly to the block.

The recess in the vinyl block can alternately be provided with one or more flat sides and the carriage bolt can be a machine bolt with a hexagonal head or a square head such that the recess functions to prevent the bolt from turning as the nut is threaded onto the bolt.

The steel brackets are then welded to the steel support bar.

The vinyl blocks, the brackets, the steel bar, the tie back rods and the steel beams are then all covered with back fill material such as gravel, sand, and soil up the top of the sheet piling wall structure.

The resulting wall provides a smooth front surface of colored vinyl. No fastener heads or other connecting hardware is visible on the front side. The back side of the wall is completely covered by earth, grass, or other ground cover. Only the undulating or corrugated top edge of the vinyl sheet piling is observed on the top of the wall. No top cap is required.

Although the exemplary embodiment sheet piles are described as being composed of vinyl, other non-steel, plastic or polymer materials can also be used, such as a fiberglass compound.

Numerous other advantages and features of the present invention will be become readily apparent from the following detailed description of the invention and the embodiments thereof, from the claims and from the accompanying drawings.

BRIEF DESCRIPTION OF THE DRAWINGS

FIG. 8 is a fragmentary top perspective view of prior art vinyl sheet piles; and FIG. 9 is a fragmentary perspective view of a prior art vinyl sheet piling wall.

DETAILED DESCRIPTION OF THE PREFERRED EMBODIMENTS

Figure 1:
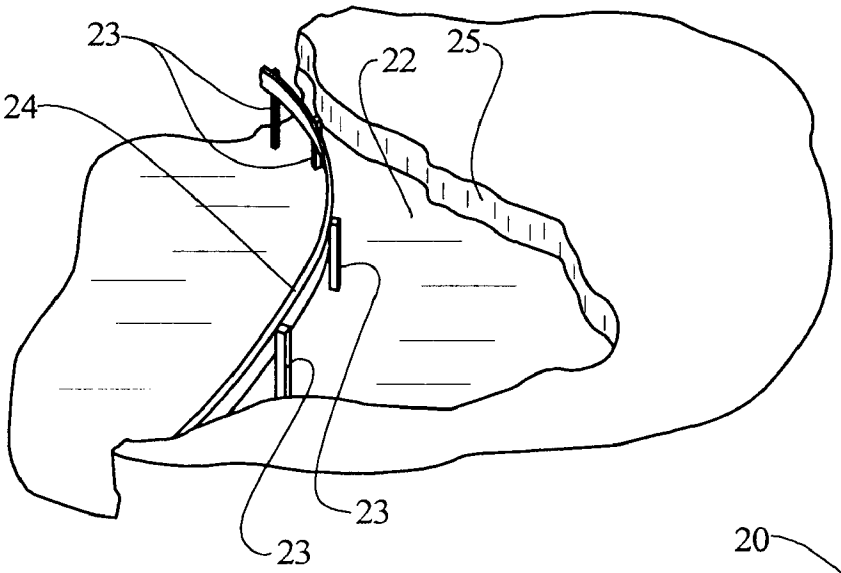
FIG. 1 is a perspective view of a first stage of construction of a vinyl sheet piling wall according to the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a shoreline reclamation project undertaken in accordance with the present invention. A receding shoreline inlet 22 is to be filled in with earth. Accordingly, a wall 20 (FIG. 2) is built. Initially, a plurality of tubular steel stakes 23 are driven through the water and into the earth below. A steel support bar 24 is arranged horizontally spanning between stakes 23 and welded to the stakes 23 on a side of the stakes opposite the shoreline 25. The support bar or whaler 24 is out of the water by a few feet. Typically, the stakes are 2 inch by 2 inch by 3/16 thick steel square tubes and the whaler 24 is a 2 inch wide by 3/16 inch thick steel bar.

Figure 2:
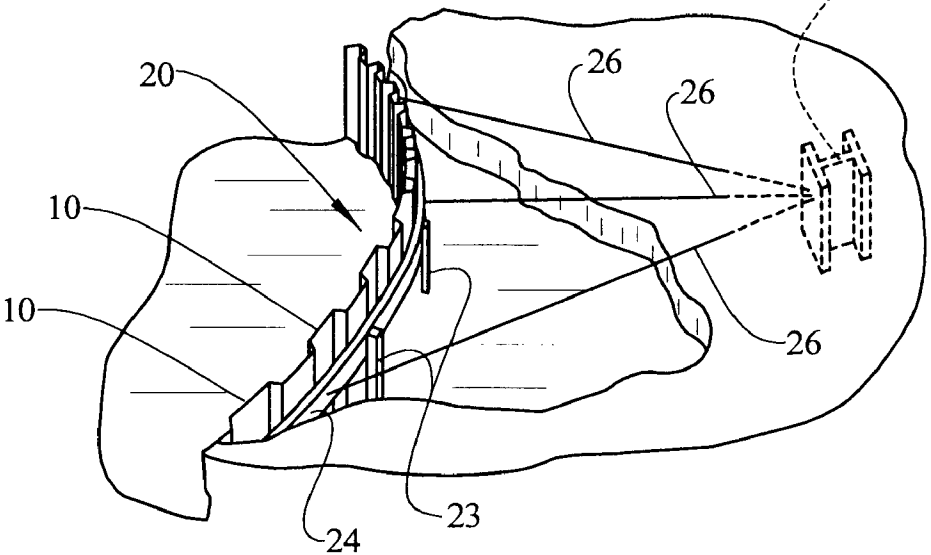
FIG. 2 is a perspective view of a second stage of construction of a vinyl sheet piling wall according to the invention.

FIG. 2 illustrates a further stage in the shoreline reclamation project, including the completion of the construction of the wall 20. A plurality of ¾" steel tie back rods 26 are welded to the bar 24 and extend back to be welded to a vertical steel I beam or wide flange beam 27 that has been driven down to the point of refusal. A bracket (not shown) can be used to connect multiple tie back rods 26 to the beam 27. As an alternative to the beam 27, a MANTA-RAY brand earth anchor can be used, available from Foresight Products of Commerce City, Colo.

A plurality of vinyl sheet piles 10 are driven through the water and into the soil below to a sufficient depth, such as to the point of refusal. The sheet piles 10 are driven in succession with their adjacent edges mutually interlocking along their lengths as they are driven down. The sheet piles 10 are driven to be against the bar 24. The sheet piles 10 are connected to the bar 24 as described below in FIGS. 4-7.

Figure 3:
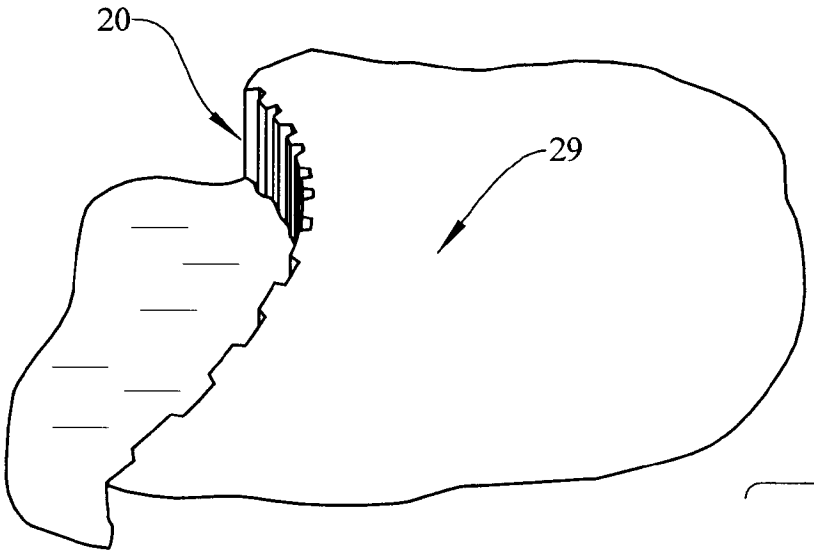
FIG. 3 is a perspective view of a third stage of construction of a vinyl sheet piling wall according to the invention.

FIG. 3 illustrates the completed shoreline reclamation project. The wall 20 has been back filled to fill the inlet 22 shown in FIG. 1 with sand, gravel and/or soil 29. The fill 29 can be filled to be flush with the top edge of the wall 20. Only the corrugated top edge of the wall 20 is seen on shore, however from the water, or from across the water, a smooth fastener-free and top cap-free colored vinyl wall 20 is observed, which is aesthetically attractive.

Figure 5:
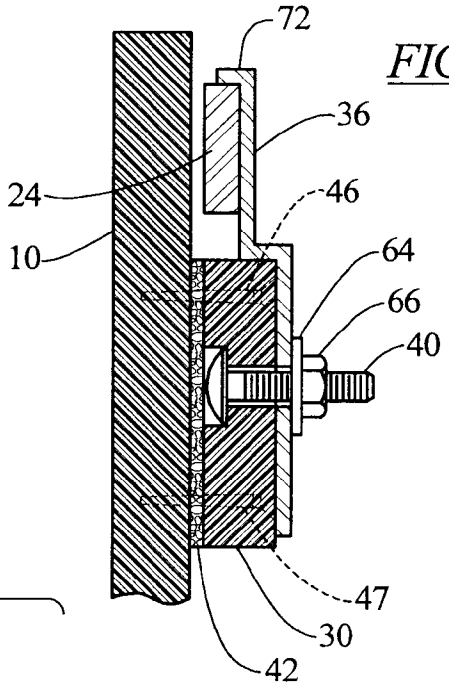
FIG. 5 is a sectional view taken generally along line 5-5 of FIG. 4.
Figure 6:
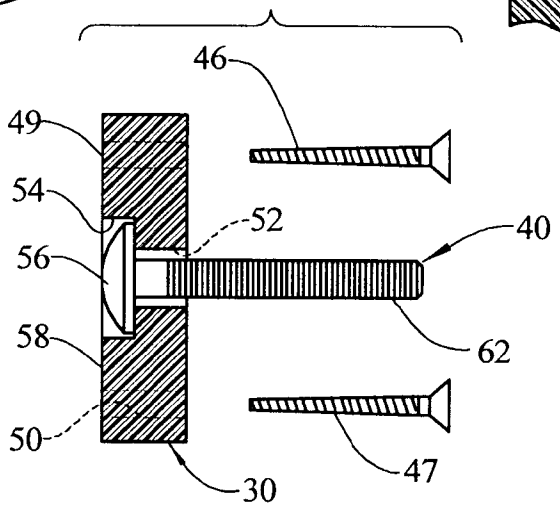
FIG. 6 is an enlarged, exploded sectional view of the vinyl block glued shown in FIG. 5.
Figure 4:
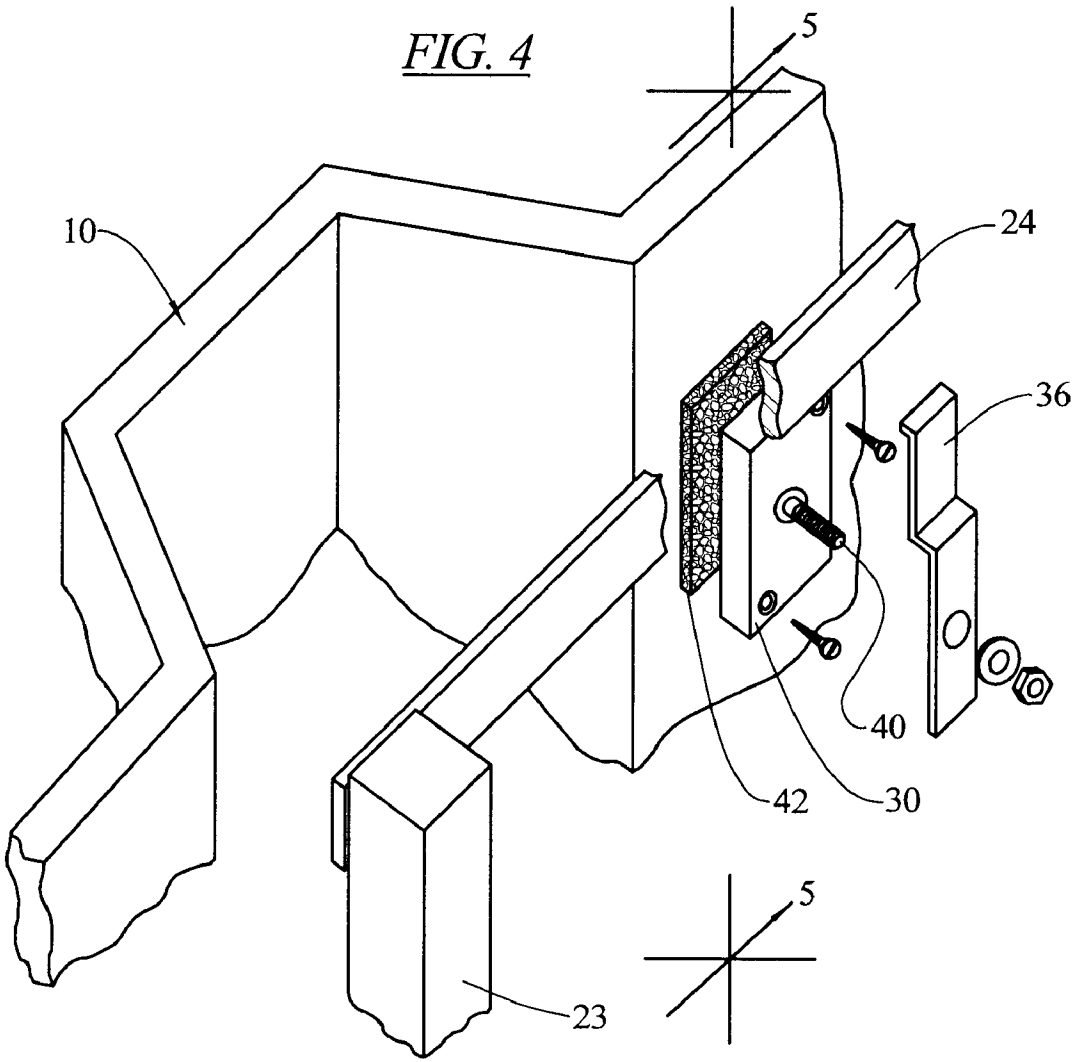
FIG. 4 is an enlarged, exploded fragmentary perspective view of a portion of the wall shown in FIG. 2.

FIGS. 4-6 illustrate one method of attachment of the vinyl sheet pile 10 to the steel support bar 24. A vinyl block 30 and a steel bracket 36 are used to connect the vinyl sheet pile 10 to the steel support bar 24. The vinyl block 30 is adhesively secured to the sheet pile 10. A carriage bolt 40 carried by the block 30 fastens the block 30 to the bracket 36.

The present inventor has determined that an effective adhesive 42 useful for securing the vinyl block 30 to the vinyl sheet pile 10 is a two-component methacrylate adhesive, FUSION-BOND™ 371 engineered structural adhesive, manufactured by Hernon Manufacturing, Inc. of Sanford, Fla., U.S. The adhesive 42 is applied to the sheet pile 10 back surface (see FIG. 4) and or to the block 30. While the adhesive sets, the block 30 is held to the sheet pile 10 by two screws 46, 47.

The vinyl block 30 has two straight-through holes 49, 50 for receiving the screws 46, 47 and a countersunk hole 52 for receiving the bolt 40. The countersunk hole 52 includes a recess 54 for receiving the head 56 of the bolt 40, recessed from a back surface 58 of the block 30. Alternatively, the recess 54 could include one or more flat sides and the bolt could be a machine bolt with a square or hexagonal head such that the flat sides prevent the bolt 40 once installed from rotating when a nut is threaded onto a threaded shank 60 of the bolt 40.

The threaded shank 60 of the bolt 40 connects the vinyl block 30 to the steel bracket 36, by use of a washer 64 and a threaded nut 66. The bracket 36 is shaped to allow the block 30 and the bar 24 to both be flush against the sheet pile 10 as shown in FIG. 5. Once the nut 66 is tightened a desired amount to anchor the sheet pile to the whaler 24, the bolt and nut are brazed to the bracket 36 to fix the relative position of the sheet pile and the whaler 24.

The bracket 36 includes a top leg 72 which contact top surface of the bar 24 which also helps to set the proper elevation of the blocks 30 against the sheet piles 10. The bracket 36 are then welded all around, between the sides of the bracket 36 and the bar 24.

Preferably, the block 30 is about 1¾ inch wide (horizontal) by 3 inch length (vertical) by 13/16 inch thick. Preferably, one block 30 is secured to the sheet piles about every 2 to 2.5 feet along the wall 20. Preferably, each block is fixed to each of the interfaces of the interlocking formations 14*a*, 16*a* of the flanges 14, 16, or adjacent to the interface on one of the flanges 14, 16.

Figure 7:
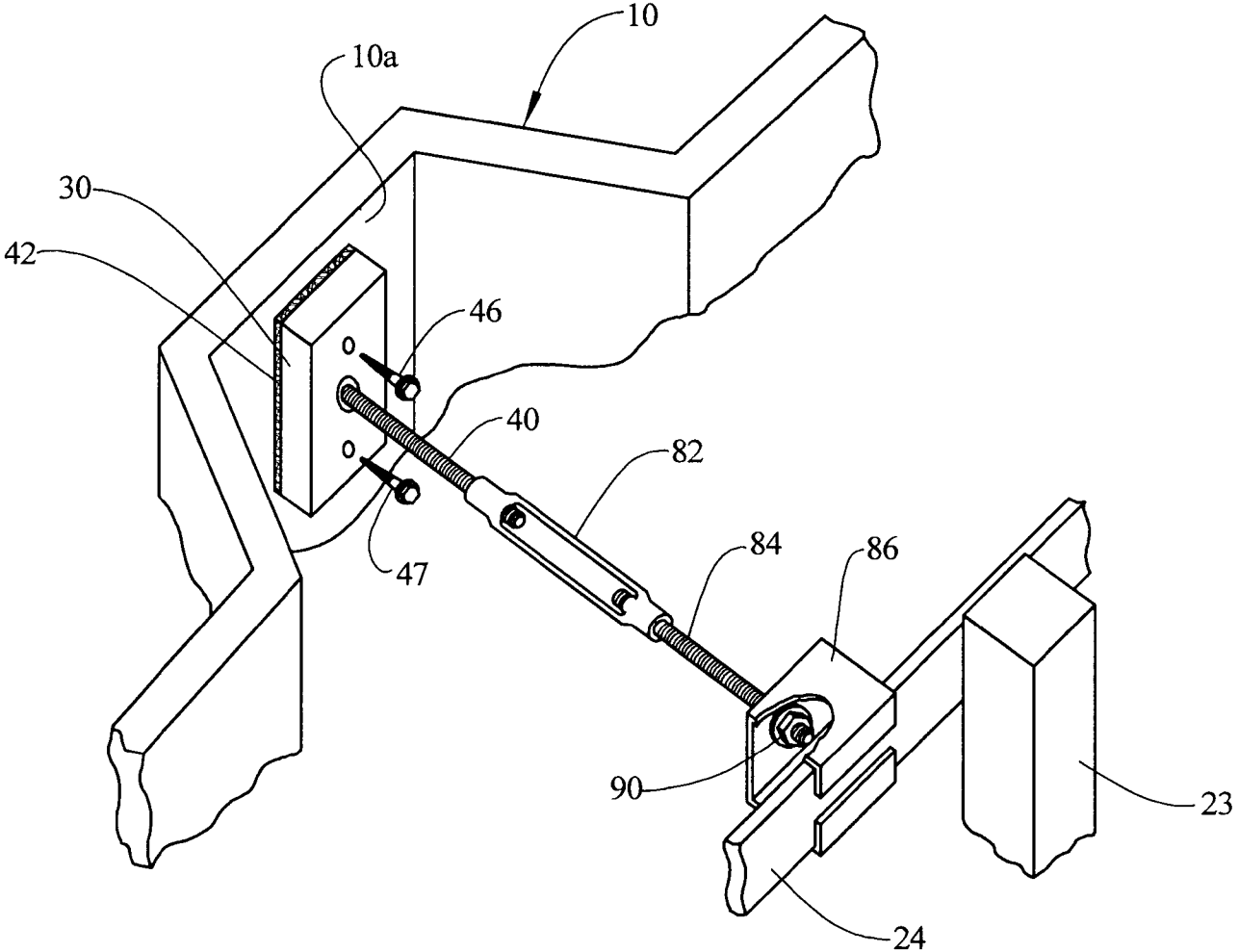
FIG. 7 is an enlarged, exploded fragmentary perspective view of another portion of the wall shown in FIG. 2.

FIG. 7 illustrates another connection detail for connecting the sheet pile 10 to the bar 24. According to this detail, the offset panel 10*a* of the vinyl sheet pile 10, the panel that is furthest away from the support bar 24, is connected to the bar 24 via the bolt 40, a turnbuckle 82, threaded rod 84, and a steel C-shaped bracket 86. The vinyl block 30 is installed onto the panel 10*a* in the same fashion as previously described. The C-shaped bracket 86 is connected to the threaded rod 84 by being captured between front and back nuts 90 (back nut not visible). The support bar 24 is captured within the C-shaped bracket 86 and welded all around thereto.

The wall of the present invention can be installed without the need for heavy construction equipment, which could damage delicate terrain such as found within a golf course. In this regard the sheet piling can be driven by an apparatus described in U.S. Pat. No. 6,966,448, herein incorporated by reference.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A sheet piling wall, comprising:

a plurality of corrugated sheet piles composed of polymer material and connected together to form a corrugated wall structure having a front surface and a back surface, the back surface in contact with the earth to retain earth to a grade level;

a plurality of blocks spaced-apart and each block adhesively secured to said back surface of said wall structure by a respective adhesive portion;

a plurality of fasteners, each of said blocks engaged to one of said plurality of fasteners;

a support bar extending horizontally behind said back surface, said plurality of fasteners operatively connected to said support bar, said blocks, said fasteners and said support bar located below grade level behind the back surface of said wall, said respective adhesive portion providing an adhesive strength sufficient to prevent separation of the respective block from the back surface by force on said wall structure by earth pressure.

2. The wall according to claim 1, wherein said blocks are composed of a polymer material.

3. The wall according to claim 2, wherein said sheet piles and said blocks are composed of vinyl.

4. The wall according to claim 1, wherein said sheet piles and said blocks are composed of vinyl.

5. The wall according to claim 1, comprising a plurality of brackets, each of said brackets engaged to one of said fasteners and said brackets fixed to said support bar.

6. A method for installing a sheet piling wall, comprising the steps of:

providing polymer sheet piling having mutually engageable lateral edges;

driving said polymer sheet piling into the earth and engaging said mutually engageable lateral edges;

adhesively attaching a plurality of blocks to a back side of said wall using adhesive portions, said back side in contact with the earth to retain earth to a grade level, said blocks spaced apart horizontally; and fastening said blocks to an earth anchorage system to stabilize said wall;

said adhesive portions providing a connection strength sufficient to prevent separation of the blocks from the back surface by force on said wall structure by earth pressure.

7. The method according to claim 6, wherein said step of fastening said blocks to said earth anchorage system is further defined by:

providing said earth anchorage system includes an earth anchor and a support bar, said support bar extending horizontally behind said back side and connected to said earth anchor, wherein said blocks are fastened to said support bar.

8. The method according to claim 7, wherein said earth anchor comprises a structural steel member driven into the earth behind said support bar and said support bar is connected to said structural steel member by a plurality of steel rods.

9. The method according to claim 8 wherein said step of fastening is further defined in that the plurality of brackets are welded to said support bar and each bracket is fastened to a respective one of said plurality of blocks.

10. The method according to claim 6 wherein said sheet piling is composed of vinyl.

11. The method according to claim 10, wherein said blocks are composed of vinyl.

* * * * *